US011719414B2

(12) United States Patent
Sabeti

(10) Patent No.: US 11,719,414 B2
(45) Date of Patent: Aug. 8, 2023

(54) APPARATUS, SYSTEM, AND RELATED METHODS FOR LIGHT REFLECTION WITH GROOVED SURFACES

(71) Applicant: Arram Sabeti, San Francisco, CA (US)

(72) Inventor: Arram Sabeti, San Francisco, CA (US)

( * ) Notice: Subject to any disclaimer, the term of this patent is extended or adjusted under 35 U.S.C. 154(b) by 0 days.

(21) Appl. No.: 17/484,590

(22) Filed: Sep. 24, 2021

(65) Prior Publication Data

US 2022/0178514 A1 Jun. 9, 2022

Related U.S. Application Data

(60) Provisional application No. 63/122,326, filed on Dec. 7, 2020.

(51) Int. Cl.

| | |
|---|---|
| ***F21V 7/04*** | (2006.01) |
| ***F21V 14/02*** | (2006.01) |
| ***A44C 15/00*** | (2006.01) |
| ***F21V 7/05*** | (2006.01) |
| ***F21V 7/10*** | (2006.01) |
| ***F21V 14/04*** | (2006.01) |
| ***F21V 7/00*** | (2006.01) |
| *F21W 121/06* | (2006.01) |

(52) U.S. Cl.

CPC ..... *F21V 7/048* (2013.01); *A44C 15/0015* (2013.01); *F21V 7/0025* (2013.01); *F21V 7/05* (2013.01); *F21V 7/10* (2013.01); *F21V 14/02* (2013.01); *F21V 14/04* (2013.01); *F21W 2121/06* (2013.01)

(58) Field of Classification Search

CPC . F21V 7/048; F21V 7/05; F21V 14/02; F21V 14/025; F21V 14/04; F21V 14/045; A44C 15/0015

See application file for complete search history.

(56) References Cited

U.S. PATENT DOCUMENTS

| | | | | |
|---|---|---|---|---|
| 2003/0167795 | A1* | 9/2003 | Metcalfe | A44C 15/0015 63/1.14 |
| 2004/0022066 | A1* | 2/2004 | Imazeki | F21S 43/30 362/509 |
| 2007/0068196 | A1* | 3/2007 | Seliktar | A44C 25/001 63/37 |
| 2015/0062916 | A1* | 3/2015 | Takayama | F21V 13/04 362/308 |
| 2017/0363943 | A1* | 12/2017 | Kurosaki | F21V 7/0025 |

* cited by examiner

*Primary Examiner* — Sean P Gramling
(74) *Attorney, Agent, or Firm* — Hayes Soloway P.C.

(57) ABSTRACT

An apparatus, system, and related methods for light reflection with grooved surfaces are provided. The light reflection apparatus with grooved surfaces has a first surface with a quantity of grooves therein. A second surface has a quantity of grooves therein. The grooves in the second surface have a different angular shape, different size, different angular orientation, or a different unit density than the grooves in the first surface. At least one light source emits light on the first and second surfaces. As a direction of the emitted light changes relative to the first and second surfaces, the quantity of grooves in the first or second surface reflect the light independently of one another.

20 Claims, 8 Drawing Sheets

APPARATUS, SYSTEM, AND RELATED METHODS FOR LIGHT REFLECTION WITH GROOVED SURFACES

CROSS REFERENCE TO RELATED APPLICATION

This application claims benefit of U.S. Provisional Application Ser. No. 63/122,326 entitled, "Apparatus, System, and Related Methods for Light Reflection with Grooved Surfaces" filed Dec. 7, 2020, the entire disclosure of which is incorporated herein by reference.

FIELD OF THE DISCLOSURE

The present disclosure is generally related to light reflection and more particularly is related to an apparatus, system, and related methods for light reflection with grooved surfaces.

BACKGROUND OF THE DISCLOSURE

A material's ability to reflect or absorb light is often a consideration for use of that material within a product or structure. For example, different types of glass and mirrors which are highly reflective are often used in products which are required to transmit light, such as devices which use laser light. Highly reflective materials are also commonplace with safety products, such as reflectors on vehicles or reflective fabrics within clothing. When light reflection is not desired, materials which tend to absorb light are used. For instance, when it is desired to prevent glare, such as with driving vehicles, light absorbing marking paint may be used on roadways. Additionally, light absorption or reflective materials are often used in decorative elements, such as outdoor sculptures, such as Chicago's Cloud Gate sculpture, which is designed to reflect a distorted skyline view of the city of Chicago.

In many situations, however, there is a desire to better control the ability of a material to reflect light, a direction of light reflection, or other characteristics of light reflection. While controlling the ability to reflect or direct light can be achieved with mirrors or other highly reflective materials being positioned or oriented at the desired angle, the ability to reposition these materials to achieve varying reflection patterns may require mechanical devices, such as mounts, actuators, or similar repositioning devices. Even then, certain reflective materials may not be suitable in all situations. For instance, while glass mirrors are reflective, they are also highly susceptible to breaking or shattering, such that they are not suitable for certain environments.

Thus, a heretofore unaddressed need exists in the industry to address the aforementioned deficiencies and inadequacies.

SUMMARY OF THE DISCLOSURE

Embodiments of the present disclosure provide an apparatus, system, and related methods for light reflection with grooved surfaces. Briefly described, in architecture, one embodiment of the apparatus, among others, can be implemented as follows. The light reflection apparatus has a first surface with a quantity of grooves therein. A second surface has a quantity of grooves therein. Relative to the quantity of grooves in the first surface, the quantity of grooves in the second surface have at least one of: a different angular shape than the quantity of grooves in the first surface; a different size than the quantity of grooves in the first surface; a different angular orientation than the quantity of grooves in the first surface; or a different unit density than the quantity of grooves in the first surface. At least one light source emits light on the first and second surfaces. As an orientation between the emitted light to the first and second surfaces changes by either moving the first and second surfaces or moving the at least one light source, the quantity of grooves in the first surface reflects the emitted light independently of the quantity of grooves in the second surface.

The present disclosure can also be viewed as providing an apparatus for reflecting light with grooved surfaces. Briefly described, in architecture, one embodiment of the apparatus, among others, can be implemented as follows. A surface has a quantity of grooves therein. The surface is formed from a material, wherein the quantity of grooves within the surface are formed by removing portions of the material. At least one light source emits light on the surface. As an orientation between the emitted light to the surface changes by either moving the surface or moving the at least one light source, the quantity of grooves in the surface reflects the emitted light in varying directions.

The present disclosure can also be viewed as providing methods of reflecting light with a grooved surface. In this regard, one embodiment of such a method, among others, can be broadly summarized by the following steps: providing a first surface having a quantity of grooves therein; providing a second surface having a quantity of grooves therein, wherein the quantity of grooves in the second surface has at least one of: a different angular shape than the quantity of grooves in the first surface; a different size than the quantity of grooves in the first surface; a different angular orientation than the quantity of grooves in the first surface; or a different unit density than the quantity of grooves in the first surface. Light is shined from at least one light source on the first and second surfaces. An orientation between the light to the first and second surfaces is changed by either moving the first and second surfaces or moving the at least one light source. The light from the quantity of grooves in the first surface reflects independently of reflecting the light from the quantity of grooves in the second surface.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
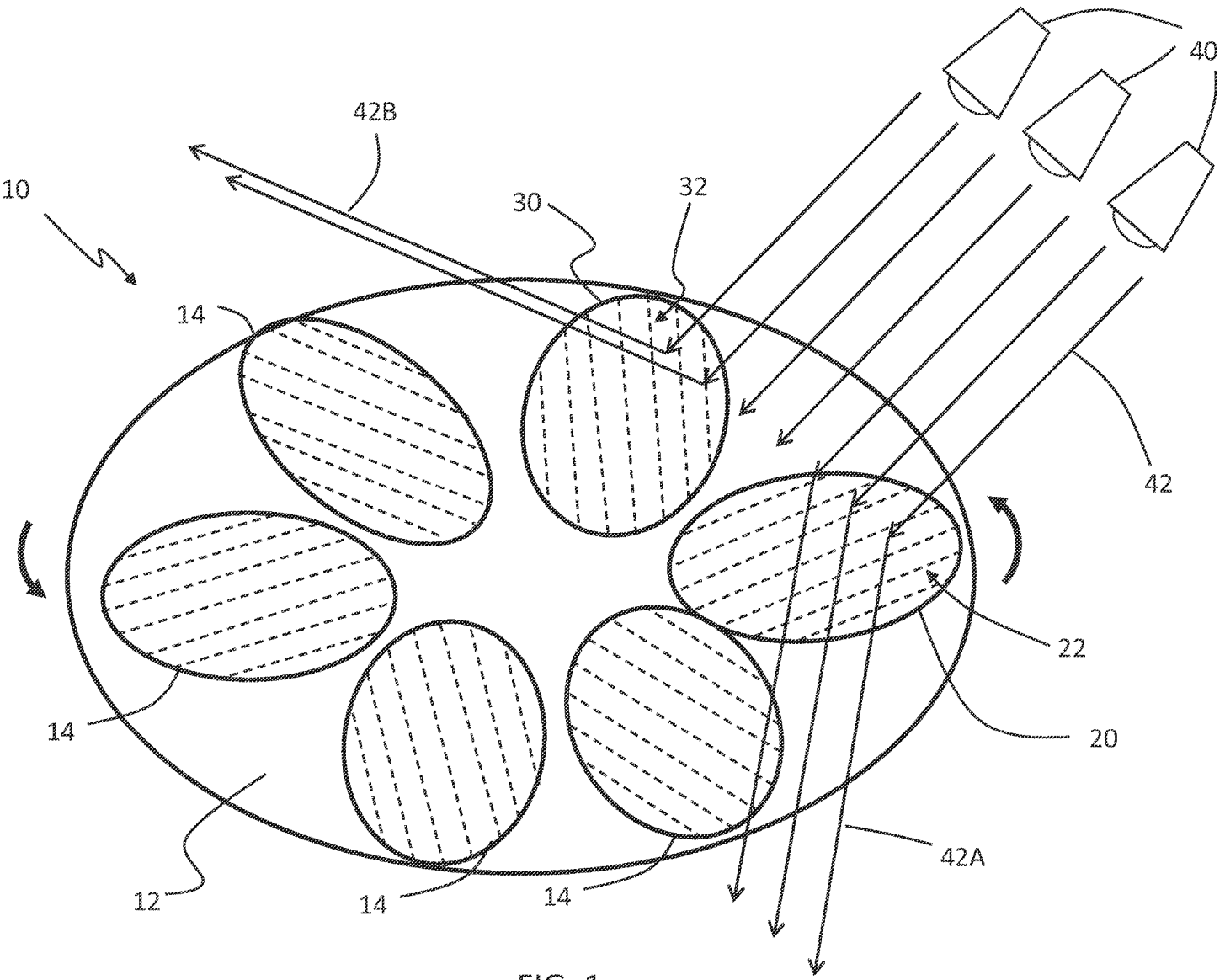
FIG. 1 is a diagrammatical illustration of an apparatus for light reflection with grooved surfaces, in accordance with a first exemplary embodiment of the present disclosure.

To provide heightened abilities to control the reflection of light, an apparatus for light reflection with grooved surfaces 10, as depicted in FIG. 1, is provided. The apparatus for light reflection with grooved surfaces 10, which may be referred to herein simply as 'apparatus 10' includes a first surface 20 having a quantity of grooves 22 formed therein. A second surface 30 is also provided, where the second surface 30 has a quantity of grooves 32 formed therein. The quantity of grooves 32 in the second surface 30 differs from the grooves 22 in the first surface 20, in that, the grooves 22, 32 have a different angular shape than one another. There may be any additional number of other surfaces having other grooves therein. At least one light source 40 is provided. The light source 40 emits a quantity of light 42 on the first and second surfaces 20, 30. As a direction of the emitted light 42 changes relative to the first and second surfaces 20, 30, the quantity of grooves 22, 32 in the first or second surface reflect the light 42A, 42B independently of one another.

In greater detail, the apparatus 10 may be used to control the independent reflection of light from various surfaces based on different angular grooves 22, 32 within those surfaces. As shown in FIG. 1, the first and second surfaces 20, 30 may be two of numerous surfaces which are positioned on a centralized holder, base, or plate 12. While this disclosure discusses the use of the first and second surfaces 20, 30 it is noted that any number of grooved surfaces may be included, with each of the grooved surfaces having different or similar grooves formed thereon. For example, FIG. 1 illustrates the plate 12 with approximately six different grooved surfaces, each of which is contained within a portion 14 of the plate 12, such that the location of different angular grooves 22, 32 are distinct from one another. In other examples, the grooved surfaces may be in different angular orientations, such as where the grooves 22, 32 have dissimilar spatial orientations on the plane of the plate 12, e.g., such that the grooves 22, 32 are not parallel to one another. It is also noted that the grooves 22, 32 can be situated with portions 14 fully abutting each other, or even overlapping one another.

The plate 12 may be a structure which has a mounting surface, commonly planar in shape, to which the grooved surfaces 20, 30 can be affixed to or formed on. The plate 12 may have any size or shape, such as being a large size with a circular shape, e.g., such as being 1-10 feet in diameter, or it may be smaller with a non-circular shape, such as when it is less than a foot in width. The plate 12 may be mounted to a mounting device, such as a holder or stand, for instance, one which allows the plate 12 to rotate or otherwise move. Accordingly, the holder or stand may utilize any mechanical or electro-mechanical devices to control movement of the plate 12, such as, for example, bearings, rotational joints, servo motors, actuators, belts, pulleys, gears, or any other device.

The grooved surfaces 20, 30 may be formed from various materials. For instance, it may be common for the grooved surfaces 20, 30 to be formed from a metal which is malleable enough to form a groove within the surface thereof. The metal material may include copper, bronze, steel, gold, silver, or any other type of metal or metallic compound. It is also possible to plate the metal surfaces 20, 30 in a different metal with an electroplating or sputter coating process, such that an inexpensive metal can be used as the main substrate while a more expensive or more reflective metal, such as gold or silver, is provided to reflect light. Other materials may also be used, including plastics, glass, resin-based materials, polymers, or any other type of material. The material used may be selected based on the intended use and design of the apparatus. Additionally, it is noted that the inscribed grooves can be delicate and difficult to clean if they get dirty. To prevent contamination or obstruction of the light reflection, it is possible to seal the surface 20, 30 with grooves 22, 32 under a transparent protective coating, such as a lacquer, polyurethane, or similar fully or semi-transparent protective coating. Such a coating, if used, may fill all or a portion of the grooves 22, 32, yet still allow light reflection from the grooves 22, 32.

Figure 2A:
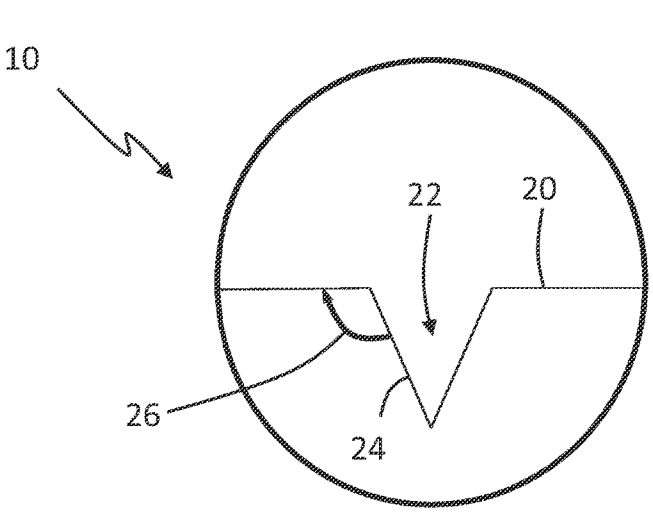
FIGS. 2A-2D are various diagrammatical illustrations of grooves within the grooved surfaces of the apparatus for light reflection with grooved surfaces of FIG. 1, in accordance with the first exemplary embodiment of the present disclosure.
Figure 2B:
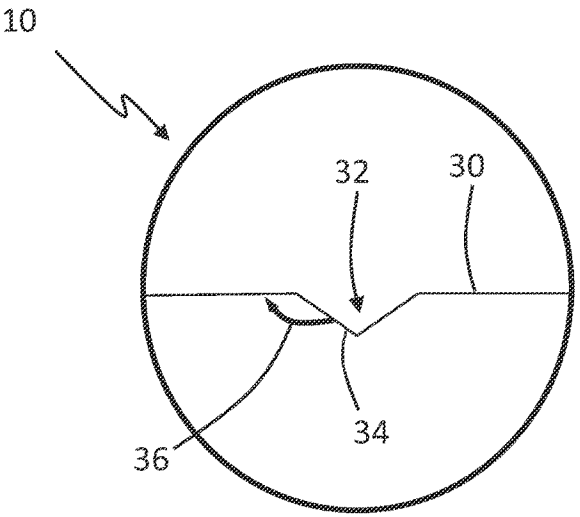
Figure 2C:
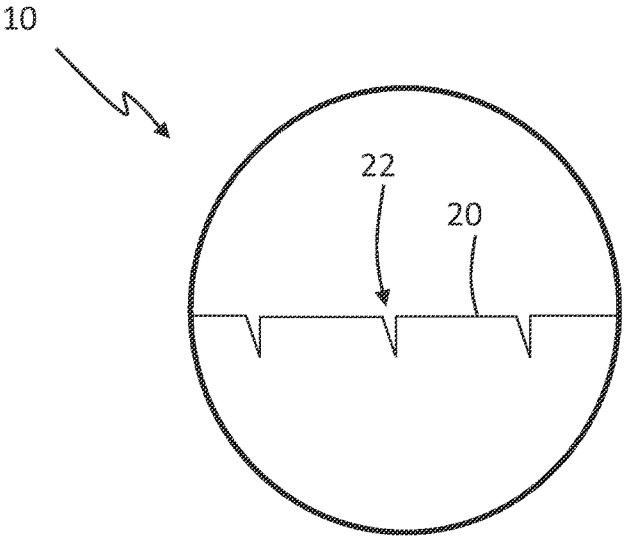
Figure 2D:
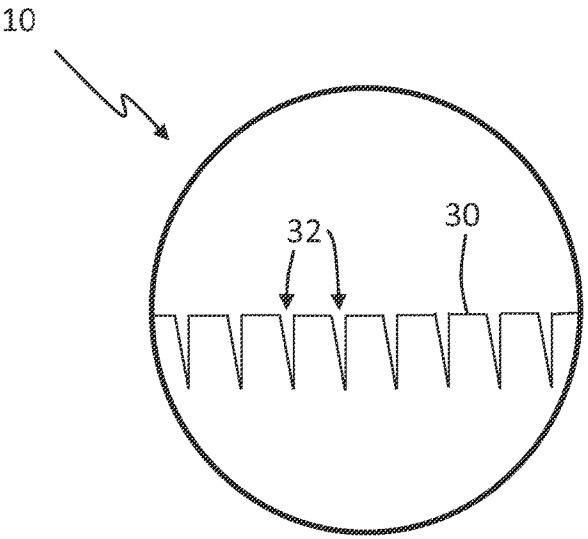

FIGS. 2A-2D are various diagrammatical illustrations of grooves within the grooved surfaces of the apparatus for light reflection with grooved surfaces of FIG. 1, in accordance with the first exemplary embodiment of the present disclosure. With reference to FIGS. 1-2D, the grooves 22, 32 of surfaces 20, 30 are formed within the surface and descend into the material. The grooves 22, 32 may have varying angular dimensions, such that one or more sidewalls 24 of the grooves 22, 32 has a particular angular position relative to the substantially planar shape of the surface 20, 30 the groove 22, 32 is formed within. For instance, as shown in FIG. 2A, the groove 22 of surface 20 may have a sidewall 24 with an angle, as indicated by arrow 26, between 90° and 135° of the surface 20 from which the sidewall 24 of the groove 22 extends, whereas in FIG. 2B, the sidewall 34 of the groove 32 may be formed at a larger angle 36, such as greater than 135° from the surface 30 from which the sidewall 34 of the groove 32 extends. However, it is noted that the groove 22, 32 within surface 20, 30 may have an angle of any size, for instance, an angle smaller than 90°, an angle between 90° and 135°, and/or an angle larger than 135°, all of which are considered within the scope of this disclosure. By varying the angular shape of the groove 22, 32, the depth of the groove 22, 32 can be varied, both of which can affect the reflection of light from the sidewall 24, 34 of the groove 22, 32.

Figure 3B:
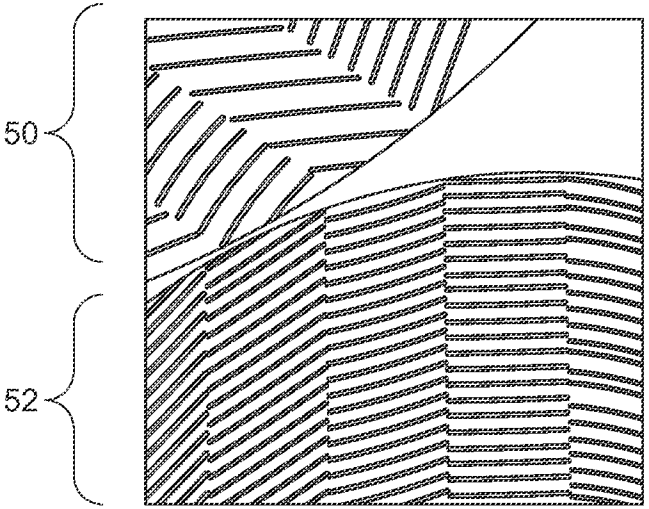
FIGS. 3A-3B are illustrations of the apparatus for light reflection with grooved surfaces, in accordance with the first exemplary embodiment of the present disclosure.
Figure 3A:
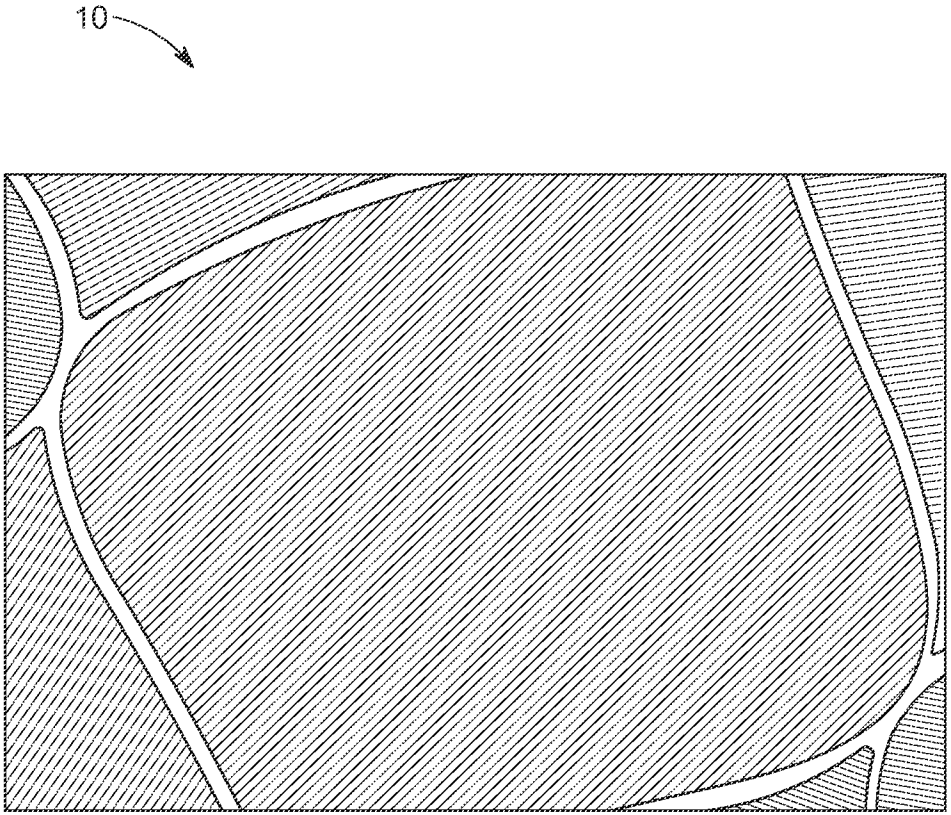

Additionally, as shown in FIGS. 2C-2D, the number of grooves 22, 32 per unit area of the surface 20, 30 can be varied, such that the grooved surface 20 in FIG. 2C has less grooves per unit area than grooved surface 30 in FIG. 2D. This may be understood as the unit density of grooves. It is also noted the size of the grooves 22, 32 within a given unit of length or area can be varied without varying the number of grooves 22, 32 themselves, such as by providing more or less surface 20, 30 space between the grooves 22, 32 themselves, such as where an opening of the grooves 22, 32 as measured between the sidewalls 24, 34 at the junction to the surface 20, 30 are enlarged. As an example of differing groove-per-unit-area, FIG. 3A is an illustration of a surface with a higher number of grooves per unit area, such as one square inch of surface 20, whereas FIG. 3B is an illustration of two surfaces with a lower number of grooves per unit area. Additionally, as shown in the figures, the grooves 22, 32 may be symmetrical, asymmetrical, with planar sides, with curved sides, or have any other variation. Similarly, it is possible to use grooves 22, 32 which cross over one another to create a crosshatch pattern, such that a single region can reflect light in different directions simultaneously.

Additionally, it is noted that the positioning of the grooves 22, 32 can be varied. For example, as shown in FIG. 1, the grooves 22 of the first surface 20 may be positioned extending in one linear direction, while the grooves 32 of the second surface 30 are positioned extending in a different linear direction. It is also possible for a surface 20, 30 to have grooves 22, 32 which are positioned in different linear directions all within the same surface 20, 30. For instance, grooves 22, 32 within the same surface 20, 30 can have alternating groove direction, e.g., when columns or rows of grooves 22, 32 are formed in the surface 20, 30 with alternating groove directions between adjacent columns or rows. For example, FIG. 3B illustrates this groove pattern in a first portion 50 of the illustration. In another example, it is possible for the grooves 22, 32 to be positioned on a circular surface 20, 30 with each groove 22, 32 that is positioned along a radial path formed substantially tangentially within the circular surface 20, 30. FIG. 3B illustrates this groove pattern in a second portion 52, thereof.

Figure 4A:
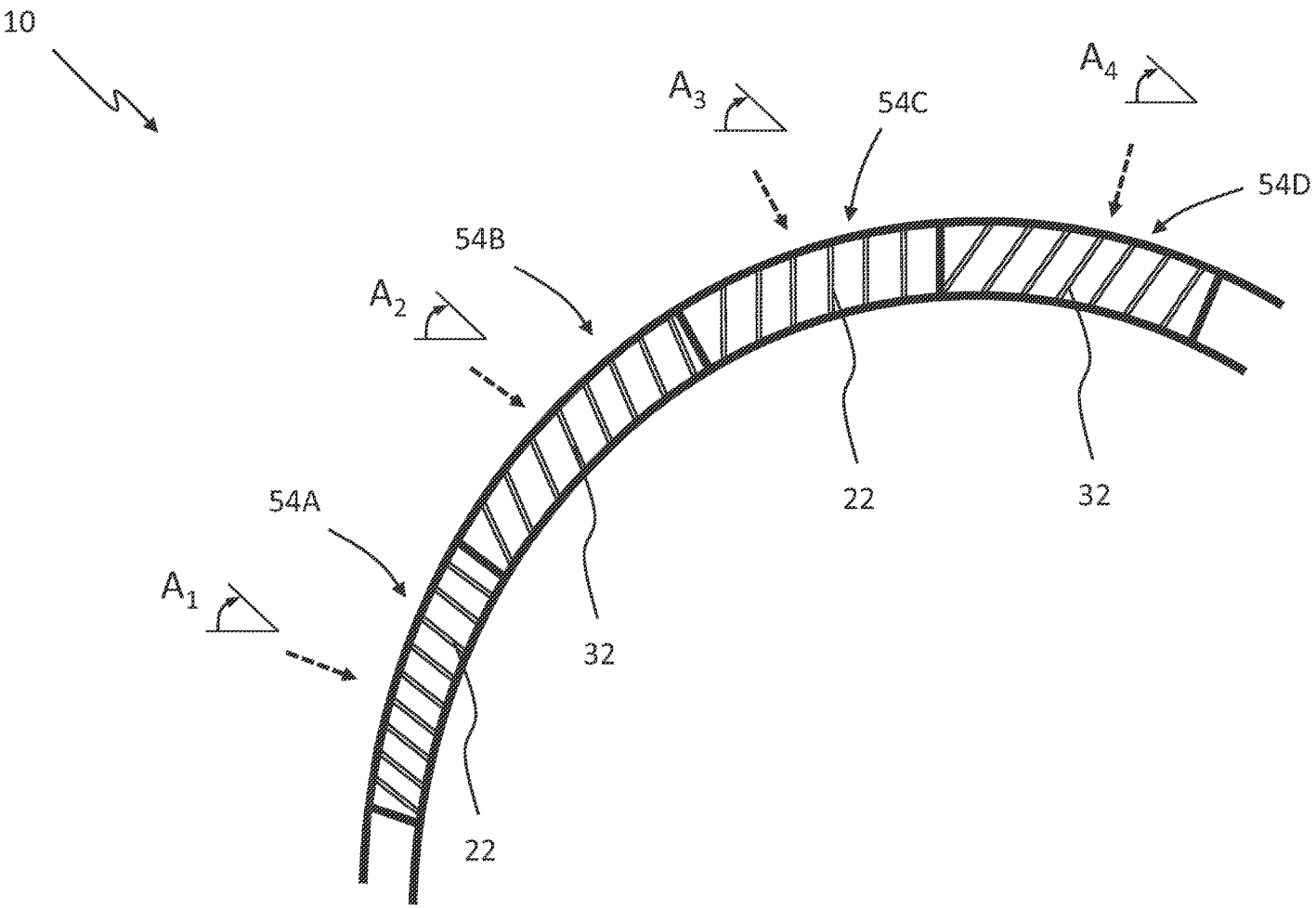
FIGS. 4A-4B are diagrammatical illustrations of a groove pattern of the apparatus for light reflection with grooved surfaces, in accordance with the first exemplary embodiment of the present disclosure.
Figure 4B:
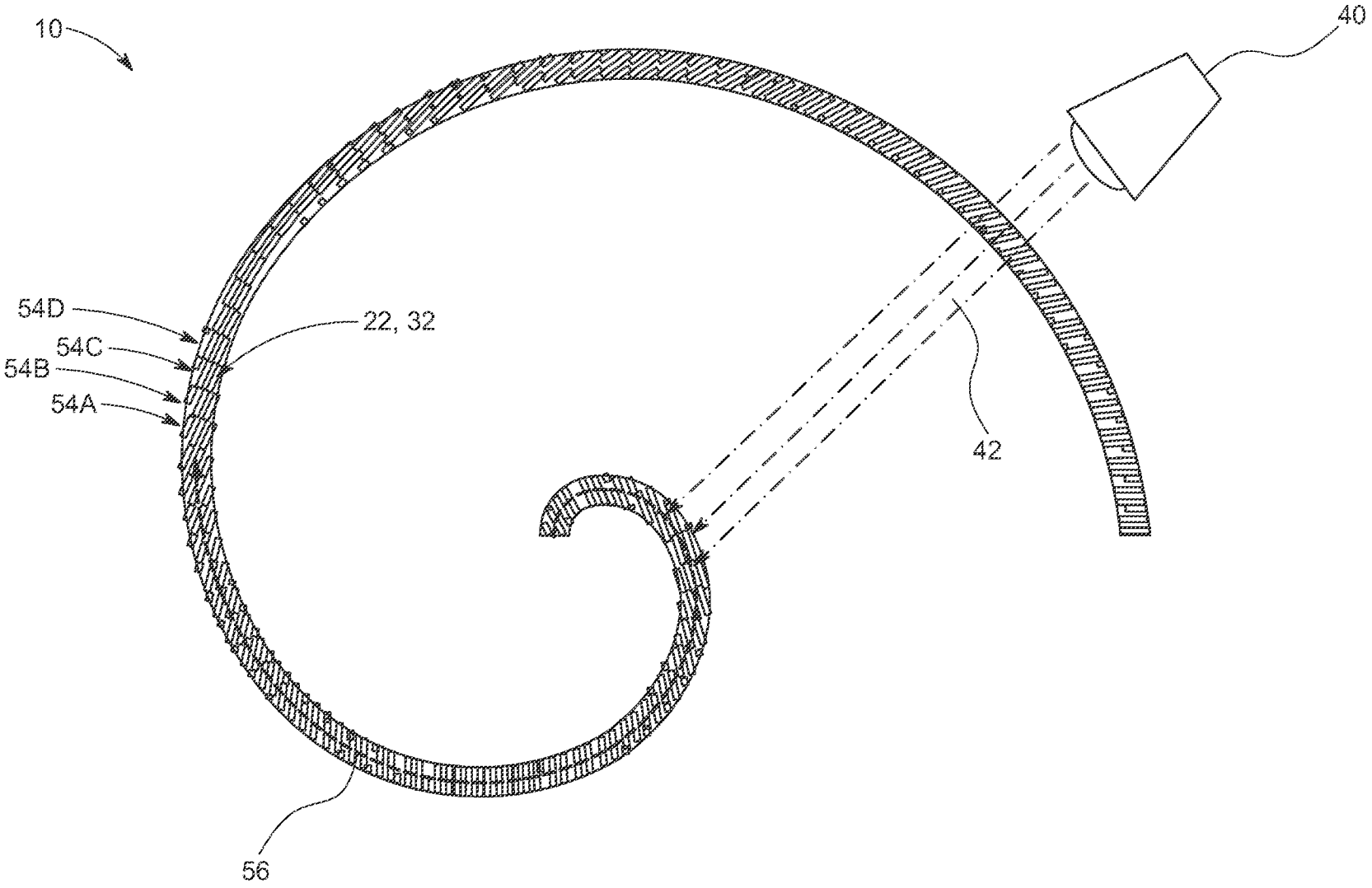

Beyond having grooves 22, 32 within rows or columns, it is also possible to orient grooves 22, 32 within a linear or curved path, a concept referred to as path scintillation. For example, FIGS. 4A-4B are diagrammatical illustrations of a groove pattern of the apparatus for light reflection with grooved surfaces, in accordance with the first exemplary embodiment of the present disclosure. As shown in FIGS. 4A-4B, a linear of curved path is provided with distinct segments 54A-54D therein, where each of the segments 54A-54D has a plurality of grooves 22, 32 formed therein.

While previous examples utilized a region or portion with parallel grooves therein, such that all grooves within the region reflected light at the same time, the path scintillation example of FIGS. 4A-4B uses parallel grooves only within a specific segment 54A-54D, such that one segment 54A-54D reflects light at a given point in time. When a plurality of segments 54A-54D are positioned adjacent to one another, each of which has a different angle $A_1$-$A_4$, it is possible for the light to reflect off the grooves 22, 32 at different periods of time. Thus, as the light is moved or as the surface containing the grooves 22, 32 is moved relative to the light, the reflected light gives the appearance of following an arbitrary path or curve along the segments 54A-54D. Path scintillation is possible with any curved or straight path, where it is divided into segments 54A-54D, and each segment 54A-54D is filled with grooves 22, 32 that have a different angle than a previous segment 54A-54D. Commonly, the change between the angles $A_1$-$A_4$ of the segments 54A-54D may be incremental, such that the light appears to move or travel up the path.

FIG. 4A illustrates a diagrammatic illustration of path scintillation with exemplary segments 54A-54D, each of which has different angles $A_1$-$A_4$ of grooves 22, 32. In practice, path scintillation may appear as illustrated in FIG. 4B, which illustrates a large number of shortened segments 54A-54D where the change of angular position between grooves 22, 32 within each of the segments 54A-54D is incremental. In use, as the path with the plurality of segments 54A-54D is rotated relative to one or more light sources 40 emitting light 42 or if the light sources 40 are moved relative to the grooves 22, 32, the reflected light will visually appear to travel along the path, as indicated by broken-lined arrow 56.

For any of the implementations of the present disclosure, the grooves 22, 32 may be formed within the surfaces 20, 30 by any known techniques. In one example, the grooves 22, 32 are formed within the surface 20, 30 using an inscription technique where a hardened implement is moved across the surface 20, 30 with a downward force. In another example, a computer numerical controlled (CNC) machine may be used to precisely and efficiently drag a diamond tipped engraving bit across the surface to form the groove 22, 32. When a CNC machine is used, software can be used to generate a particular design with any number of surfaces 20, 30, whereby the software controls or recommends the particular type of groove 22, 32 within each surface 20, 30. This software can communicate with a CNC machine which intakes gcode to control the movement of the CNC machine engraver. Other processes may also be used, such as chemical etching, stamping, molding, or similar techniques.

As previously noted, the angular shape of the grooves 22, 32 can cause light to reflect from the grooved surface 20, 30 in different directions. As such, by placing a quantity of grooves 22 with the same angular shape within one of the surfaces 20, and a second quantity of grooves 32 with the same angular shape within the other surfaces 30, it is possible to reflect light in two or more different directions. When the surfaces 20, 30 are moved, such as when they are rotated, or when the light source 40 is moved or rotated relative to the surfaces 20, 30, different illumination effects can be created. For example, by varying the angle between the light source 40, the surfaces 20, 30, and the viewer, different sections of the surfaces 20, 30 can be made to appear to light up. In other words, the light from the light source 40 can be reflected at different angles on the different surfaces 20, 30 such that different beams of light are reflected into the viewer's eye based on the particular angle of the light source 40 to the surfaces 20, 30, and based on the characteristics of the groove 22, 32 within the surfaces 20, 30.

Figure 5:
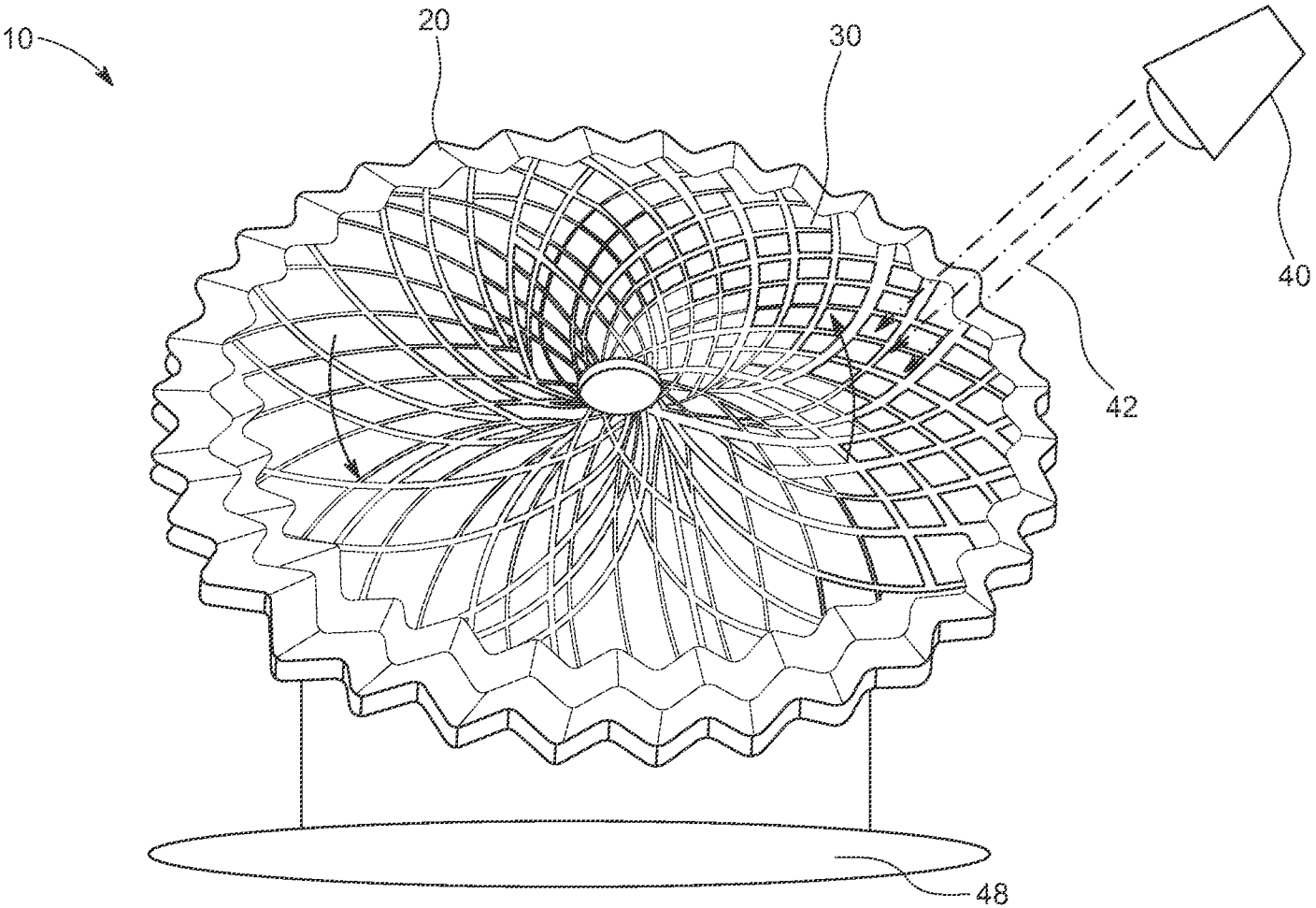
FIG. 5 is an illustration of an apparatus for light reflection with grooved surfaces, in accordance with the first exemplary embodiment of the present disclosure.

In one preferred embodiment, the surfaces 20, 30 are mounted on a kinetic structure (such as a rotatable plate) which is rotated relative to a stationary light source 40, such that as the surfaces 20, 30 move, the viewer sees different light reflections. The result is an animation effect, where the light dances across the surfaces 20, 30 in a visually pleasing manner. Any type of mechanical or electromechanical device can be used to rotate the surfaces 20, 30, such as an electromagnetic motor, a blade powered by the wind or a flow of water, or any other device capable of causing rotational movement. A similar effect can be achieved by keeping the surfaces 20, 30 stationary and moving the light source 40 relative to the surfaces 20, 30. FIG. 5 is an illustration of the apparatus 10 as a kinetic structure, where the surfaces 20, 30 are being rotated relative to a light source 40 emitting light 42. As can be seen in the illustration, the reflection of light on the different surfaces 20, 30 causes brighter and darker areas on the apparatus 10. As the apparatus 10 is rotated, such as on a rotational mount 48 which holds the surfaces 20, 30, the brighter and darker areas move from various surfaces 20, 30 to create an illuminated animation. The illuminated animations can include various types, such as spiral patterns, radial movements from the center to the outer edge, interspersed light patterns where light shifts between the surfaces 20, 30 in more abstract patterns, or any other pattern. The resulting effect can appear as a dynamic light mosaic.

It is also possible to display non-abstract patterns, such as photographs, text, designs, symbols, or other recognizable elements. For instance, the motion can be programmed to have specific behaviors which influence the animation, such as mimicking the motion of a clock pendulum, providing directional movement instructions for vehicular or pedestrian traffic, or others.

Moreover, other effects can be created by changing other physical parameters of the surfaces 20, 30. For instance, the surfaces 20, 30 may be mounted on an angle or tilt while being rotated, or independent of any rotation, such that light is reflected angularly. It is also possible to configure different surfaces 20, 30 such that they can be independently moved, and where their motion or lighting can be coordinated.

Figure 6:
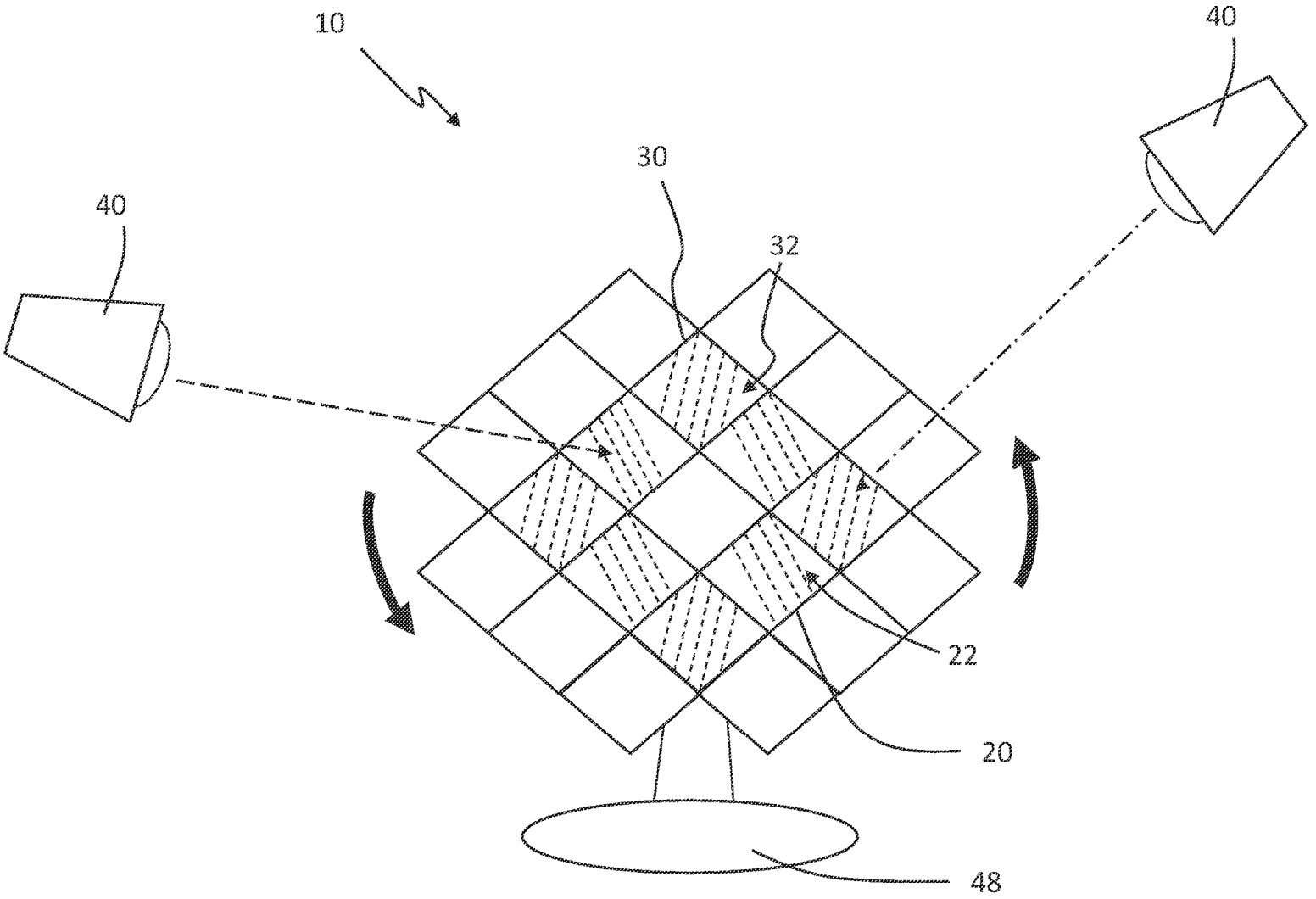
FIG. 6 is a diagrammatical illustration of an apparatus for light reflection with grooved surfaces, in accordance with the first exemplary embodiment of the present disclosure.

In an additional example, as depicted in the diagrammatical illustration of FIG. 6, it is possible to use multiple light sources 40 positioned or arranged to illuminate the surfaces 20, 30, or to be incidental to the environment. When multiple light sources are used, it is possible to vary the colors of the lights to create differently colored visual effects. It is also possible to have multiple surfaces 20, 30 of the apparatus to be illuminated by placing different light sources at different angles. When this occurs, some surfaces 20, 30 are illuminated with one color whereas other surfaces are illuminated with a different color. Virtually any light reflection effect created by moving the inscribed surfaces 20, 30 relative to illuminated lights, such as by rotating the surfaces 20, 30 on a rotational mount 48, and/or moving the lights relative to the inscribed surfaces 20, 30, or both movement of the surfaces 20, 30 while moving the lights is envisioned, all of which are considered within the scope of the present disclosure. It is noted that further effects can be created by varying the speed of rotation or movement of the surfaces 20, 30, by pulsing different color lights at a frequency informed by the rotation rate of the surfaces 20, 30, or allowing the motion of the surfaces 20, 30, or lighting, or color of the lighting to be determined by interactive input such as sound, the beat of music, nearby motion, or other input from the environment.

Figure 7B:
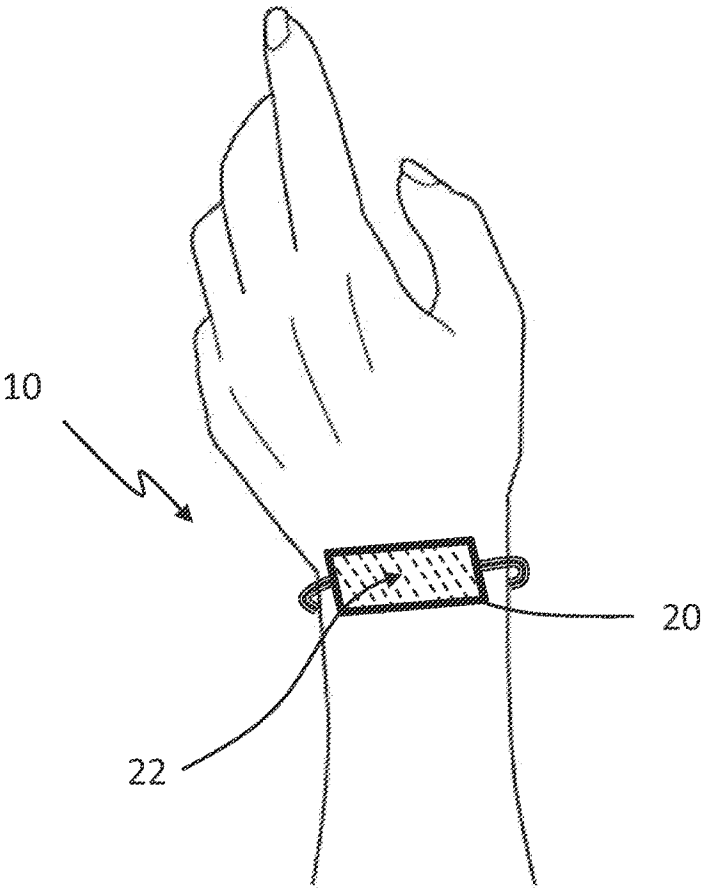
FIGS. 7A-7B are diagrammatical illustrations of the apparatus for light reflection with grooved surfaces implemented in jewelry, in accordance with the first exemplary embodiment of the present disclosure.
Figure 7A:
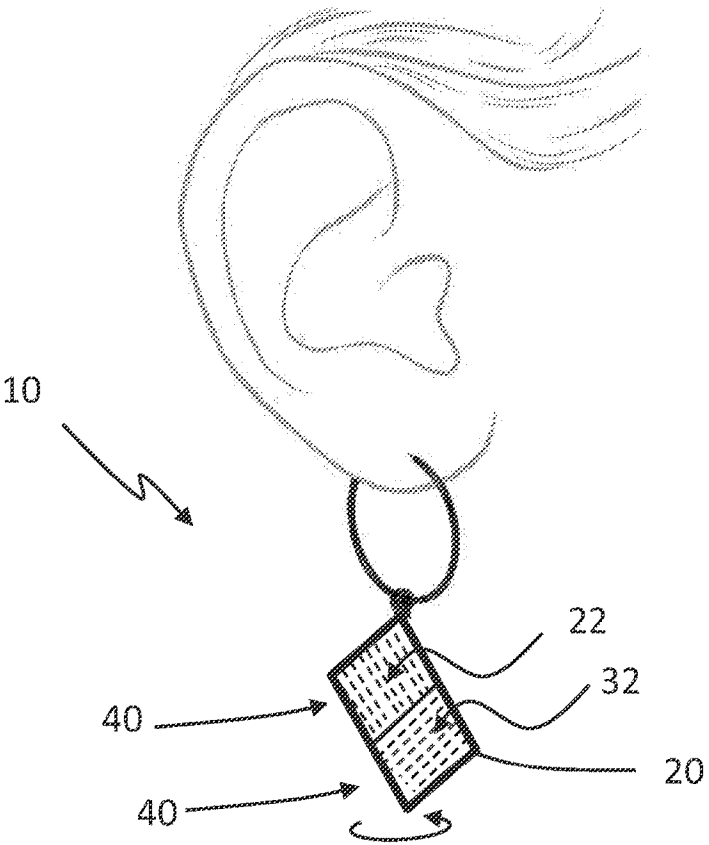

Additionally, it is possible that the grooves can be formed within the metal surfaces of items beyond larger, planar metallic sheets. For instance, the grooves can be formed within artworks such as sculptures, architectural structures in buildings, and jewelry such as earrings, necklaces, bracelets, rings, badges, and other forms, where the motion of the user, the observer, and lighting can create the appearance of glowing, motion, or animation of patterns. These jewelry items may be constructed from metals or other materials, such as plastics or glass. FIGS. 7A-7B are diagrammatical illustrations of the apparatus for light reflection with grooved surfaces implemented in jewelry, in accordance with the first exemplary embodiment of the present disclosure. As shown in FIG. 7A, an earring may have one or more surfaces 20 which has one or more portions 40, each of which contains a quantity of grooves 22, 32 therein. As the individual wearing the earring moves, the surface 20 on the earring will move, thereby allowing changes in light reflection on the grooves 22, 32. Similarly, in FIG. 7B, the jewelry item is a bracelet which has a surface 20 with grooves 22 therein, such that when the user moves his or her wrist, light is reflected in various directions off the grooves 22. Other jewelry items may include necklaces, pendants, brooches, body jewelry, or any other type of jewelry or fashion accessory. The use of the grooved surface on jewelry items may be particularly useful during entertainment events with significant lighting, such as music festivals, raves, dances, clubs, sporting events, or any other environment with numerous lights.

It is also possible for the apparatus 10 to be implemented as an indicator or a form of communication, for example, where different orientations of light relative to the user and the surfaces indicate different visual or textual messages. For example, a stop sign with a grooved surface could be animated to indicate a train is approaching. Accordingly, any use of the apparatus 10, whether decorative, utilitarian, or a combination thereof, is considered within the scope of the present disclosure. These may include, but are not limited to, safety purposes, communication, ID badges, security, entertainment, education, industrial, or others.

It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claim.

What is claimed is:

1. A light reflection apparatus with grooved surfaces comprising:

a first surface of a reflective material having a plurality of parallel grooves arranged in a first groove pattern;

a second surface of the reflective material having a plurality of parallel grooves arranged in a second groove pattern, the first surface being distinct from the second surface such that an entirety of the first groove pattern is fully separate, non-overlapping, non-intersecting, and in a different location from an entirety of the second groove pattern, and wherein the plurality of grooves in the second surface having at least one of:

a different angular shape than the plurality of grooves in the first surface;

a different size than the plurality of grooves in the first surface;

a different angular orientation than the plurality of grooves in the first surface; or a different unit density than the plurality of grooves in the first surface; and at least one light source emitting light on the first and second surfaces, wherein the emitted light does not pass through the first and second surfaces, and wherein a quantity of reflected light is emitted from the first and second surfaces while an orientation between a path of the emitted light relative to the first and second surfaces changes by either moving the first and second surfaces relative to the at least one light source or by moving the at least one light source relative to the first and second surfaces, wherein the plurality of grooves in the first surface reflects the emitted light independently of the plurality of grooves in the second surface.

2. The apparatus of claim 1, wherein the plurality of grooves in the second surface has a different angular shape than the plurality of grooves in the first surface, wherein the different angular shape between the plurality of grooves in the second surface relative to the plurality of grooves in the first surface further comprises a difference in an angular dimension of a sidewall of the plurality of grooves in the first surface relative to the plurality of grooves in the second surface.

3. The apparatus of claim 1, wherein the plurality of grooves in the second surface has a different size than the plurality of grooves in the first surface, wherein the different size of the plurality of grooves in the first surface relative to the plurality of grooves in the second surface further comprises a difference in opening size of the plurality of grooves in the first surface relative to the plurality of grooves in the second surface.

4. The apparatus of claim 1, wherein the plurality of grooves in the second surface has a different angular orientation than the plurality of grooves in the first surface, wherein the different angular orientation of the plurality of grooves in the first surface relative to the plurality of grooves in the second surface further comprises a difference in spatial orientations of the plurality of grooves in the first surface relative to the plurality of grooves in the second surface on a plane of a plate on which the plurality of grooves is positioned.

5. The apparatus of claim 1, wherein the plurality of grooves in the second surface has a different unit density than the plurality of grooves in the first surface, wherein the different unit density of the plurality of grooves in the first surface relative to the plurality of grooves in the second surface further comprises a difference in a number of grooves per unit of length or area of the plurality of grooves in the first surface relative to the plurality of grooves in the second surface.

6. The apparatus of claim 1, further comprising a substantially planar plate, wherein the first and second surfaces are mounted to the substantially planar plate.

7. The apparatus of claim 6, wherein the substantially planar plate is supported by a mounting device.

8. The apparatus of claim 7, wherein the mounting device is rotatable, whereby rotation of the mounting device causes the substantially planar plate and the first and second surfaces thereon to move in a rotational path.

9. The apparatus of claim 1, wherein the first and second surfaces further comprise segmented portions within a scintillation path, wherein reflection of the emitted light moves along the scintillation path.

10. The apparatus of claim 1, wherein the at least one light source is moved relative to the first and second surfaces, which remain stationary.

11. The apparatus of claim 1, wherein at least one of the first and second surfaces are mounted to a jewelry item.

12. An apparatus for reflecting light with grooved surfaces, the apparatus comprising:

a surface having at least a first groove pattern formed from a plurality of parallel grooves therein and at least a second groove pattern formed from a plurality of parallel grooves therein, the surface formed from a reflective material, wherein the plurality of grooves within the surface are formed by removing portions of the material from the surface, wherein each of the plurality of grooves has two planar sidewalls which meet at a vertex, and wherein an entirety of the first groove pattern is fully separate, non-overlapping, non-intersecting, and in a different location on the surface from an entirety of the second groove pattern; and at least one light source emitting light on the surface, wherein the emitted light does not pass through the surface, and wherein a quantity of reflected light is emitted from the surface while an orientation of a path of the emitted light between the emitted light relative to the surface changes by either moving the surface relative to the at least one light source or by moving the at least one light source relative to the surface, wherein the plurality of grooves in the first surface reflects the emitted light independently of the plurality of grooves in the second surface such that the surface reflects the emitted light in varying directions.

13. The apparatus of claim 12, further comprising a substantially planar plate, wherein the surface is mounted to the substantially planar plate.

14. The apparatus of claim 13, wherein the substantially planar plate is supported by a mounting device.

15. The apparatus of claim 14, wherein the mounting device is rotatable, whereby rotation of the mounting device causes the substantially planar plate and the surface thereon to move in a rotational path.

16. The apparatus of claim 12, wherein the surface is mounted to a jewelry item.

17. A method of reflecting light with a grooved surface, the method comprising:

providing a first surface on a reflective material having a plurality of parallel grooves therein, wherein the plurality of parallel grooves are arranged in a first groove pattern;

providing a second surface on a reflective material having a plurality of parallel grooves therein, wherein the plurality of parallel grooves are arranged in a second groove pattern, wherein the first surface is distinct from the second surface such that an entirety of the first groove pattern is fully separate, non-overlapping, non-intersecting, and in a different location from an entirety of the second groove pattern, and wherein the plurality of grooves in the second surface has at least one of:

a different angular shape than the plurality of grooves in the first surface;

a different size than the plurality of grooves in the first surface;

a different angular orientation than the plurality of grooves in the first surface; or a different unit density than the plurality of grooves in the first surface;

shining light from at least one light source on the first and second surfaces, wherein the emitted light does not pass through the first and second surfaces; and reflecting the light from the plurality of grooves in the first surface independently of reflecting the light from the plurality of grooves in the second surface while changing an orientation between a path of the light to the first and second surfaces by either moving the first and second surfaces relative to the at least one light source or by moving the at least one light source relative to the first and second surfaces.

18. The method of claim 17, wherein the first and second surfaces are formed from metal or metal compounds, wherein the plurality of grooves in the first and second surfaces are formed from an inscription technique.

19. The method of claim 17, wherein reflecting the light from the plurality of grooves in the first surface independently of reflecting the light from the plurality of grooves in the second surface further comprises reflecting the light along a scintillation path.

20. The method of claim 17, wherein moving the first and second surfaces further comprises moving the first and second surfaces in a rotational path with a mounting device.

* * * * *